US007125298B1

(12) United States Patent
Frank

(10) Patent No.: US 7,125,298 B1
(45) Date of Patent: Oct. 24, 2006

(54) MAN OVERBOARD BEACON

(75) Inventor: Thomas A. Frank, Middletown, RI (US)

(73) Assignee: The United States of America represented by the Secretary of the Navy, Washington, DC (US)

( * ) Notice: Subject to any disclaimer, the term of this patent is extended or adjusted under 35 U.S.C. 154(b) by 8 days.

(21) Appl. No.: 11/076,108

(22) Filed: Feb. 18, 2005

(51) Int. Cl.
*B63B 22/00* (2006.01)

(52) U.S. Cl. ..... 441/11; 441/17; 441/18

(58) Field of Classification Search ..... 441/11, 441/17, 18
See application file for complete search history.

(56) References Cited

U.S. PATENT DOCUMENTS 4,063,323 A 12/1977 Salvarezza
5,029,293 A 7/1991 Fontanille
5,091,714 A 2/1992 de Solminihac
5,274,359 A 12/1993 Adams
5,359,331 A * 10/1994 Adler ..... 342/124
5,748,080 A 5/1998 Clay
5,800,044 A 9/1998 Marshall
5,886,635 A 3/1999 Landa et al.
5,945,912 A 8/1999 Guldbrand
6,067,017 A * 5/2000 Stewart et al. ..... 340/573.1

* cited by examiner

*Primary Examiner*—Stephen Avila
(74) *Attorney, Agent, or Firm*—Jean-Paul A. Nasser; James M. Kasischke; Michael P. Stanley

(57) ABSTRACT

A user worn man overboard beacon that provides multiple indication means to alert a ship to an overboard crew person and to assist in locating the crew person. The beacon device is contained in a housing attached to the clothing of the sailor and is activated upon contact with seawater. A battery powers the multiple indicators contained in the housing, which include a high intensity strobe light to provide a visual indication, an x-band radar patch antenna to transmit a radar signal indication that can be detected by the ship's radar system, and an acoustic transducer to project an acoustic signal indication that can be detected by the ship's sonar system.

19 Claims, 2 Drawing Sheets

MAN OVERBOARD BEACON

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER RELATED APPLICATIONS

Not applicable.

BACKGROUND OF THE INVENTION (1) Field of the Invention

The present invention relates to beacons, and more specifically to a beacon device that can alert a ship if a crewmember falls overboard and can assist the ship in locating the crewmember.

(2) Description of the Prior Art

On large naval vessels, especially aircraft carriers, with the harried activity that occurs on deck involving multiple crewmembers, sailors run the risk of falling overboard during operations without being noticed. In situations where a person has fallen off a ship at sea, the time elapsing between going overboard and being rescued is inversely proportional to the chance of survival for the overboard sailor. It is therefore critical that the ship be alerted immediately of such an occurrence before a fatality occurs. It is also critical that the ship be alerted through an automated means in the event that the sailor has lost consciousness once overboard.

Currently there is no device that can be worn by U.S. Navy sailors that will significantly enhance the probability that they will be found if they fall overboard. Most life vests contain small water activated lights. Due to the low intensity of the lights, however, they are of limited use during the daytime. In conditions of reduced visibility, the low power of such lights is inadequate at night. Some vests do contain strobe lights which are much more effective, but still not ideal in daytime. The ubiquitous whistle is not likely to be heard over all the other noises on a ship. What is needed is a man overboard beacon device that provides multiple indication means to effectively alert a ship that a crewmember is overboard and to assist the ship in locating the crewmember. This is accomplished through the present invention by incorporating a visual indicator, a radar indicator and an acoustic indicator as alertment and location beacons to alert ships.

SUMMARY OF THE INVENTION

It is a general purpose and object of the present invention to provide a device that can be worn by sailors enabling them to be more readily located and rescued if they fall overboard.

It is an additional purpose that the device not compromise emissions containment rules (EMCON) of the United States Navy.

These objects are accomplished through the introduction of a man overboard beacon device that provides multiple indication means to alert a ship to an overboard crew person and to assist in locating the crew person. The beacon device is activated upon contact with seawater. A battery powers the multiple indicators, which include a high intensity strobe light to provide a visual indication, an x-band radar patch antenna to transmit a radar signal indication that can be detected by the ship's radar system, and an acoustic transducer to project an acoustic signal indication that can be detected by the ship's sonar system.

DESCRIPTION OF THE PREFERRED EMBODIMENT

Figure 1:
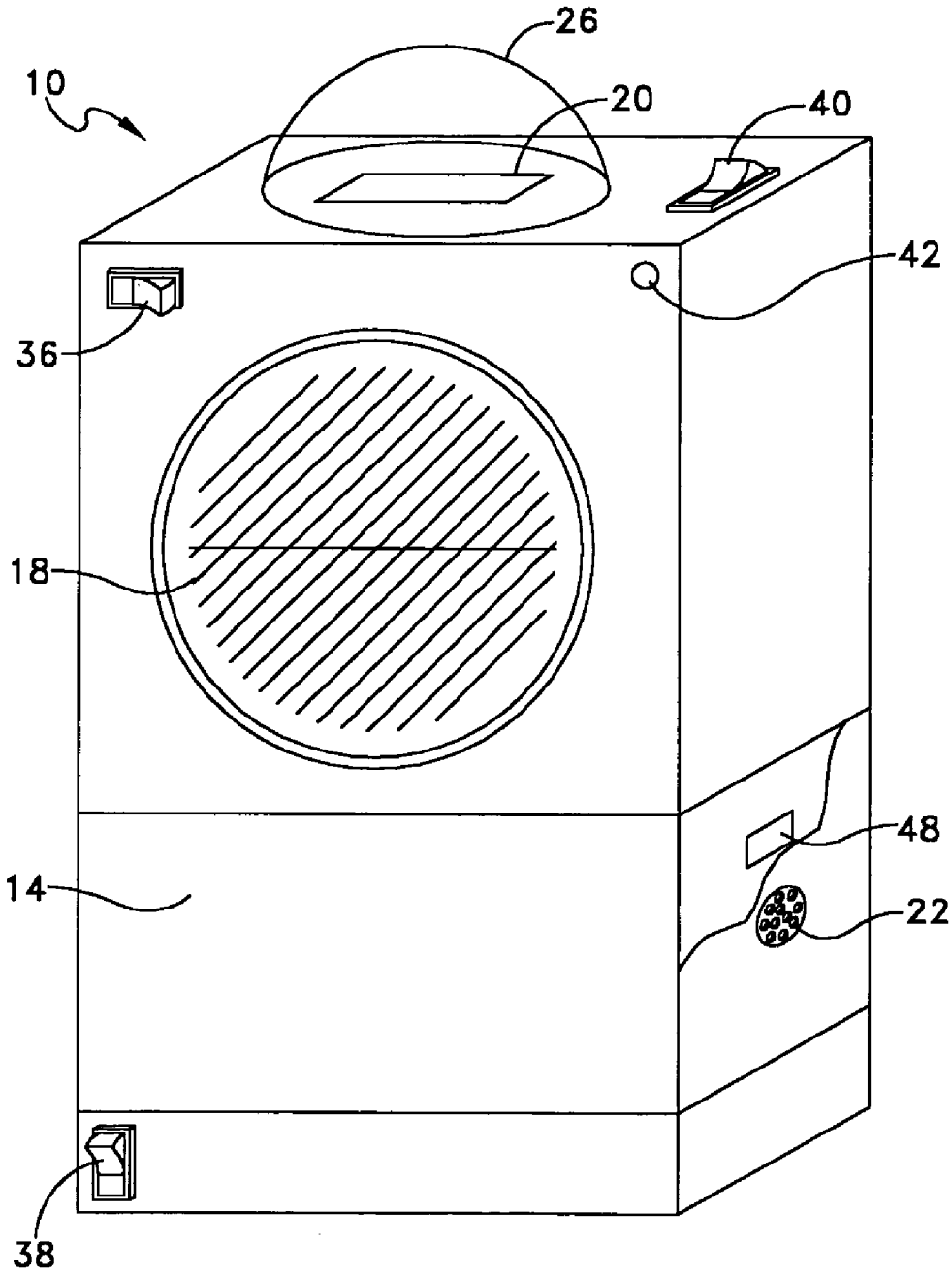
FIG. 1 shows a top and front view of the man overboard beacon.
Figure 2:
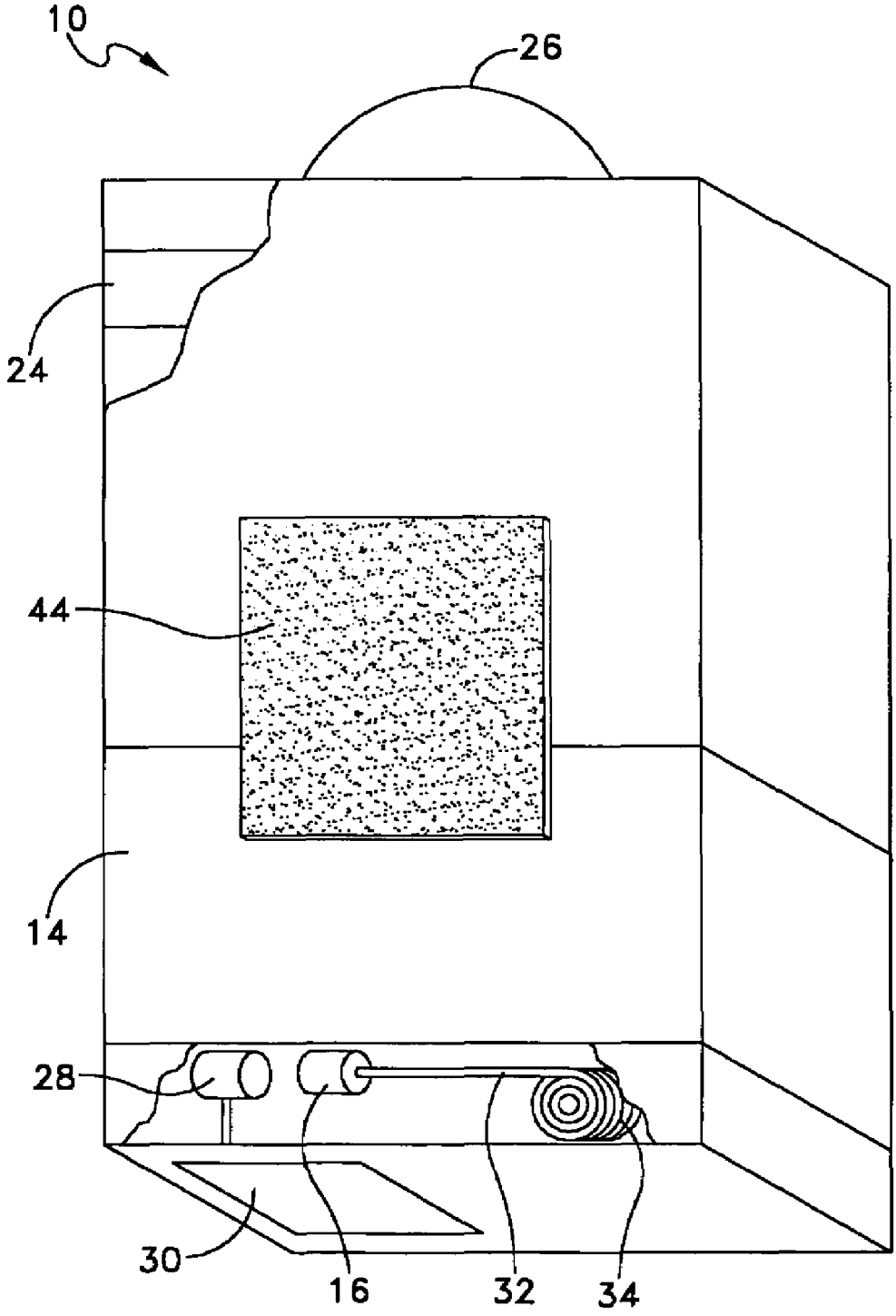
FIG. 2 shows a bottom and back view of the man overboard beacon.

The beacon 10 is contained in a housing 12. In the preferred embodiment, the housing 12 is approximately the size of a pack of cigarettes. The housing 12 can be made of any suitable waterproof material. Choice of material can be dictated by the desired weight of the beacon 10. The lighter the beacon 10 is the easier it is to use since in the preferred embodiment it is intended to be worn by the user. The housing 12 should be strong enough to sustain high impact force and should be buoyant enough to support the various components of the beacon. In the preferred embodiment, a carbon fiber shell with a Styrofoam lining is used. The housing 12 contains the various components, including a seawater activated battery 14, a small acoustic transducer 16, an X-band patch antenna 18, and a strobe light 20.

The beacon 10 is designed to activate when it comes into contact with water. There is a water inlet 22 on the side of the housing 12 such that water can flow into the inlet 22 and activate the battery 14. In the preferred embodiment, the water reacts with a micro-switch 48 that activates the battery 14. The battery 14 can be either removable or rechargeable and should be of sufficient voltage to energize various components of the beacon 10. Once the battery 14 activates it energizes the programmable X-band transceiver circuit 24. The X-band patch antenna 18 will then begin "listening" for X-band navigational radar signals that are being emitted from the ship. If the X-band patch antenna 18 detects the navigational radar signals, then that is an indication that the ship is not under emissions containment rules (EMCON). The X-band transceiver circuit 24 will then respond by broadcasting a signal through the X-band patch antenna 18. The signal will be such that the presence of the man overboard beacon 10 will be obvious on the display of the navigational radarscope on the ship's bridge. The user will be made aware of the status of the X-band transceiver circuit 24 by the indicator light 42 which in a preferred embodiment will be an LED shining green if transmitting, red if not transmitting and dark if the X-band transceiver circuit is not operating.

Activation of the battery 14 will also in turn energize the strobe light 20. In a preferred embodiment, a protective dome 26 that is transparent to light, impact resistant and water resistant, covers the strobe light 20. In a preferred embodiment, the light source for the strobe light 20 is a xenon lamp or NEOBE® lamp. Once energized, the strobe light 20 will emit a high intensity flash of white light in a periodic manner.

Activation of the battery 14 will also energize the acoustic transducer deployment apparatus 28. In a preferred embodiment, the deployment apparatus is a tube of compressed air that will discharge to force the trap door 30 at the bottom of beacon 10 to open. Once the trap door 30 is open, the battery activates the acoustic transducer 16. The acoustic transducer 16 is connected to the beacon 10 by a 3 to 6 foot long wire 32. The wire 32 is coiled around a rotating spool 34. Once the trap door 30 is open, the acoustic transducer 16 deploys from the bottom of the beacon 10 and the weight of the transducer 16 draws the wire 32 off of the rotating spool 34. The acoustic transducer 16 then begins to emit acoustic energy at a designated frequency that is easily detectable by standard passive sonar systems common throughout the U.S. Navy.

A manual override is available for all three of the alertment indicators. The X-band transceiver circuit has a three-way override switch 36 located near the X-band patch antenna 18 with settings of receive, transmit or off. The acoustic transducer 16 has an override switch 38 at the base of the beacon 10. The strobe light 20 has an override switch 40 at the top of the beacon 10. The beacon 10 as stated above is designed to be conveniently worn by the user particularly at times the user is on deck. In the preferred embodiment the beacon 10 is attached to the user's clothing by means of a Velcro fastener 44. The combined capabilities of the beacon 10 will make it much more likely that a person who has gone overboard will be detected, located and recovered in short order.

The advantages of the present invention over the prior art are that the current invention provides faster detection, classification, localization and recovery of a person who has fallen overboard by providing three different types of indicators to alert a ship and does so in a compact and convenient device that can be easily worn by the user.

What is claimed is:

1. A beacon comprising:

a housing;

a battery contained in said housing;

a transceiver circuit contained in said housing and electrically connected to said battery;

a patch antenna joined to said housing and connected to said transceiver circuit;

an acoustic transducer contained in said housing and electrically connected to said battery;

a strobe light contained in said housing and electrically connected to said battery;

a means for fastening said beacon to a user;

a seawater activated switch in electrical connection with said battery;

an aperture in said housing to allow seawater to make contact with said seawater activated switch; and a means for deploying said acoustic transducer.

2. A beacon in accordance with claim 1 wherein said housing is waterproof.

3. A beacon in accordance with claim 2 wherein said housing is impact resistant.

4. A beacon in accordance with claim 1 wherein said battery is removable.

5. A beacon in accordance with claim 4 wherein said batter is rechargeable.

6. A beacon in accordance with claim 1 wherein said transceiver circuit is an X-band radar transceiver circuit.

7. A beacon in accordance with claim 6 wherein said patch antenna is an X-band radar patch antenna.

8. A beacon in accordance with claim 6 wherein said transceiver circuit is programmable to determine when to transmit an X-band radar signal.

9. A beacon in accordance with claim 8 further comprising a visual indicator to indicate to a user when the transceiver circuit is receiving, when the transceiver circuit is transmitting and when the transceiver circuit is not operational.

10. A beacon in accordance with claim 1 further comprising a dome covering said strobe light wherein said dome is transparent to light.

11. A beacon in accordance with claim 10 wherein said dome is waterproof.

12. A beacon in accordance with claim 11 wherein said dome is impact resistant.

13. A beacon in accordance with claim 12 wherein said strobe light is a periodically flashing xenon lamp.

14. A beacon in accordance with claim 12 wherein said strobe light is a periodically flashing neobe® lamp.

15. A beacon in accordance with claim 1 wherein said acoustic transducer is electrically connected to said battery by a wire that is coiled around a spool contained within said housing.

16. A beacon in accordance with claim 15 wherein said means for deploying said acoustic transducer further comprises:

a trap door contained in said housing; and a means for opening said trap door.

17. A beacon in accordance with claim 16 wherein said means for opening said trap door is a cartridge filled with compressed air wherein said cartridge releases the compressed air to force the trap door open.

18. A beacon in accordance with claim 1 wherein said means for fastening said beacon to a user comprises a Velcro fastener.

19. A beacon in accordance with claim 1 further comprising:

a manual override switch that controls electric power to the transceiver circuit and controls operation of the transceiver circuit;

a manual override switch that controls electric power to the acoustic transducer; and a manual override switch that controls electric power to the strobe light.

* * * * *